United States Patent [19]

Kaneda

[11] 4,081,718

[45] Mar. 28, 1978

[54] DISCHARGE LAMP LIGHTING DEVICE USING A BACKSWING BOOSTER

[75] Inventor: Isao Kaneda, Otsu, Japan

[73] Assignee: NEC Sylvania Corporation, Tokyo, Japan

[21] Appl. No.: 579,092

[22] Filed: May 20, 1975

[51] Int. Cl.[2] ..... H05B 41/232

[52] U.S. Cl. ..... 315/244; 315/99; 315/106; 315/243; 315/DIG. 5

[58] Field of Search ..... 315/94, 99, 98, 103, 315/105, 106, 243, 244, DIG. 5, 96, DIG. 7, DIG. 2

[56] References Cited

U.S. PATENT DOCUMENTS

| | | | |
|---|---|---|---|
| 3,753,037 | 8/1973 | Kaneda et al. | 315/99 |
| 3,851,209 | 11/1974 | Murakami et al. | 315/99 |
| 3,866,088 | 2/1975 | Kaneda et al. | 315/105 |
| 3,942,069 | 3/1976 | Kaneda | 315/99 |

*Primary Examiner*—Eugene R. La Roche
*Attorney, Agent, or Firm*—W. G. Fasse; W. W. Roberts

[57] ABSTRACT

A discharge lamp lighting device combines one or more discharge lamps and a backswing booster including essentially a power source circuit having a power source connected in series with a ballast and a high voltage generating circuit having an oscillation capacitor and a series circuit of a nonlinear inductor and a switching semiconductor. The supply voltage for the discharge lamp from the power source circuit is established to the extent permissible by the lower limit for sustaining an arc discharge of the lamp so that the terminal voltage of the ballast in the lamp operation is maintained as low as possible. The preferred backswing booster is of small size and an impedance circuit having a capacitor either with or without a bias coil is added to the high voltage generating circuit to produce a momentary high voltage. A leakage transformer or a voltage transformer with a tap or with a supplemental winding may be coupled to the power source circuit to establish a specified potential point from which voltage for the high voltage generating circuit is supplied to reduce the applied voltage during the lamp operation. An economical lighting device for the sequential ignition of two discharge lamps by means of a single high voltage generating circuit is disclosed.

10 Claims, 22 Drawing Figures

DISCHARGE LAMP LIGHTING DEVICE USING A BACKSWING BOOSTER

BACKGROUND OF THE INVENTION

This invention relates to a discharge lamp lighting device using backswing booster means. More particularly the invention relates to a combination of a discharge lamp or lamps and a backswing booster as a compact and small rapid type and/or preheat type lamp operating apparatus.

In recent years various types of discharge lamp operating devices employing solid state circuits have been developed. One of these devices uses a voltage booster applying a backswing voltage for starting a discharge lamp as disclosed in U.S. Pat. No. 3,753,037. Such known starter comprises mainly a first oscillation circuit having a power source, a linear inductor and a capacitor connected in series, a second oscillation circuit connected across the capacitor and having a saturable nonlinear inductor and a thyristor type voltage-responsive switching element connected in series, and a third oscillation circuit comprising the nonlinear inductor and its distributed capacity. The discharge lamp is connected across the capacitor. An oscillation voltage generated across the capacitor is so high for starting the discharge lamp that a conventional grow starter may be substituted. As the power source, a d.c. or an a.c. source may be employed. Where the discharge lamp is of the hot-cathode type which has a pair of filaments serving as discharge electrodes, the filaments are generally connected in series with the first oscillation circuit and/or with the second oscillation circuit for quickly heating the filaments.

However, U.S. Pat. No. 3,753,037 does not relate to a power source circuit including the power source and a ballast for the lamp operation, so that the conventional choke coil of the glow starter is continuously used as a ballast. This reference does not provide any teaching regarding a solid state starter nor regarding the economical aspect of miniature lighting devices for operating a discharge lamp or lamps.

OBJECTS OF THE INVENTION

In view of the foregoing, it is an object of the present invention to provide an improved lighting device for discharge lamps.

A main object of the invention is to provide a miniature or small size lighting device for discharge lamps of the rapid type and of the preheat type.

Another object of the invention is to provide a discharge lamp lighting device in which the required operating voltage and the volt-ampere capacities for the circuit elements are reduced for improved economical advantages as compared to conventional devices.

A further object of the invention is to provide a lighting device for two discharge lamps employing one high voltage generating circuit for starting of the discharge lamps preferably sequentially.

SUMMARY OF THE INVENTION

These and other objects, advantages and features are attained, in accordance with the invention, by a lighting device for discharge lamps which comprises in combination one or more discharge lamps and a backswing booster comprising a first oscillation circuit having a power source, a linear inductor contained in a ballast, and a capacitor in series; a second oscillation circuit connected acorss the capacitor and having a nonlinear inductor and a voltage responsive switching semiconductor connected in series; and a third oscillation circuit connected across the nonlinear inductor and having a capacitance element preferably constituted by the distributed capacitance of the nonlinear inductor and/or an added capacitor in parallel therewith, wherein one of the discharge lamps is connected across the output terminals of said backswing booster, wherein the terminal voltage of the ballast is maintained as low as possible and the voltage applied to one of the discharge lamps is established within a range above the arc discharge sustaining voltage and below the starting voltage for the discharge lamp.

In other words, the circuit arrangement of this invention is characterized by connecting the power source voltage to the lamp voltage and comprises a discharge lamp; a power supplying circuit including a power source and a ballast for sustaining an arc discharge of the discharge lamp during operation, said ballast having at least a linear inductor and a high voltage generating circuit including a capacitor for oscillation and a series circuit of a nonlinear inductor and a switching semiconductor, said nonlinear inductor having a distributed capacitance and/or a parallel capacitor, and said semiconductor having a breakdown voltage within a range above the lamp voltage exclusive of spike voltages, or the reignition voltage in every half cycle, across the discharge lamp, as lighted, and below the maximum instantaneous voltage of the power source circuit.

As improvement, an impedance circuit having a capacitor is added to the high voltage generating circuit so that the output can be controlled suitably for generating momentary high voltage in an intermittent oscillation and/or for reducing the volt-ampere capacities of constituting parts, whereby the device may be manufactured very economically. On the other hand, the power source circuit may be improved by using a leakage transformer or voltage transformer having a tap or supplemental winding to establish a given potential point for reducing the voltage supplied to the high voltage generating circuit during the lamp operation, or by using a leakage type lead peak transformer as the ballast for applying high voltage to the high voltage generating circuit for starting the discharge lamp, but reducing the applied voltage when the discharge lamp is lighted.

According to a further feature of this invention several kinds of lighting devices are disclosed such as for a preheat or rapid type lamp lighting device using a lead phase choke coil ballast, a cold cathode type lamp lighting device, a flickerless lighting device, and a dual lamp lighting device using one high voltage generating circuit.

BRIEF FIGURE DESCRIPTION

In order that the invention may be more clearly understood, it will now be described by way of example, with reference to the accompanying drawings, wherein.

Figure 1:
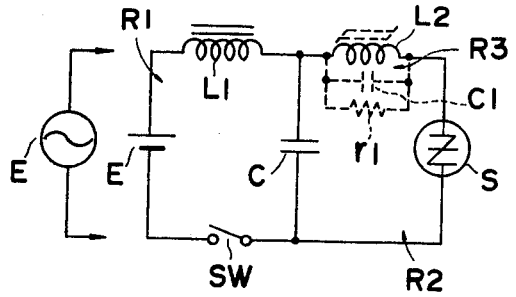
FIG. 1 is a circuit diagram of a basic backswing booster which may be employed in a discharge lamp lighting device of the present invention.
Figure 4:
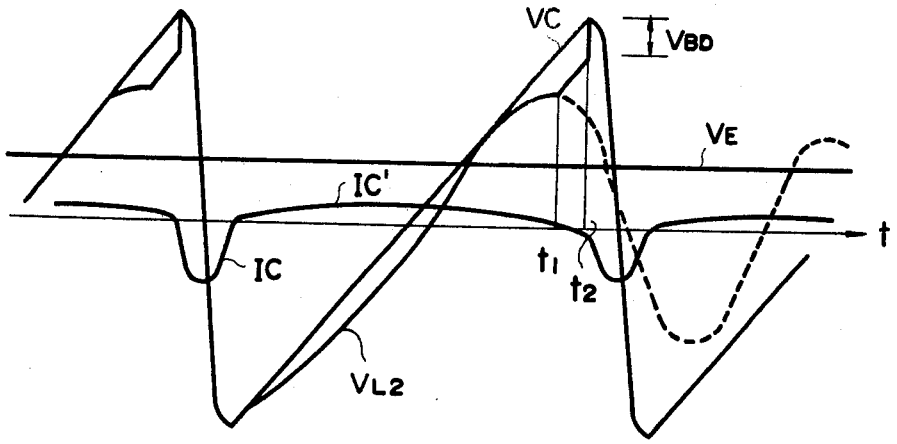
Figure 5:
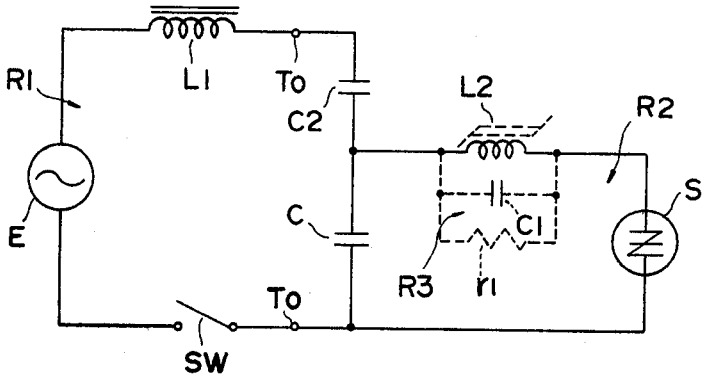
Figure 6:
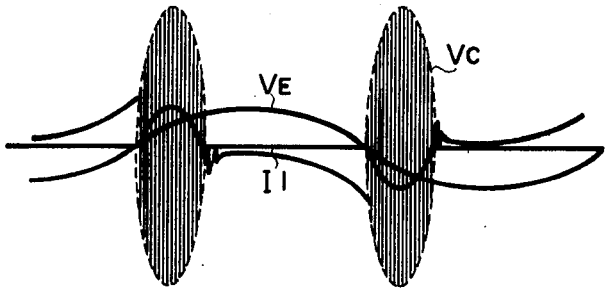
Figure 7:
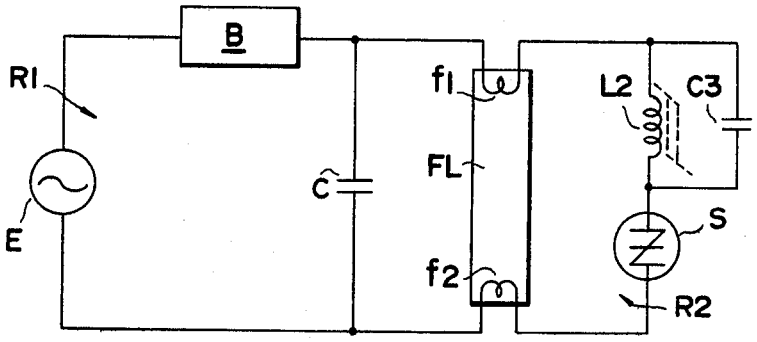
Figure 8:
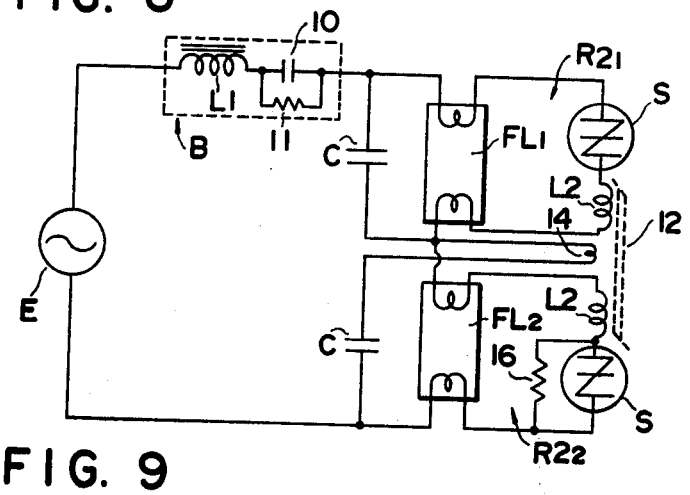
Figure 9:
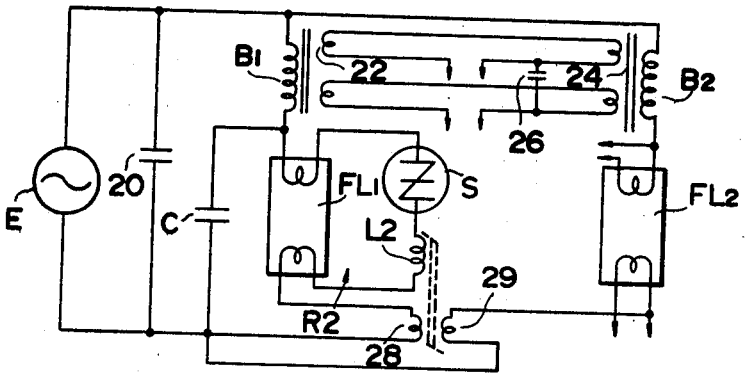
Figure 10:
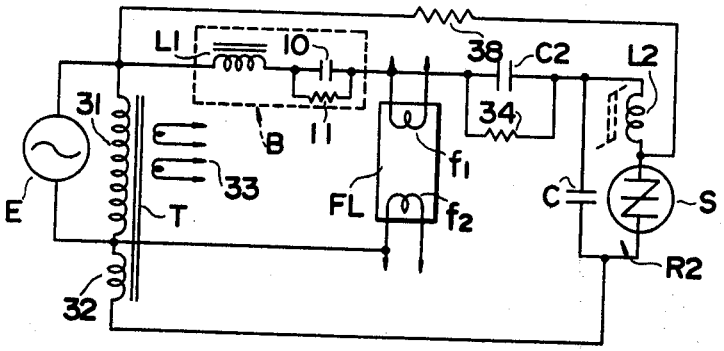
Figure 11:
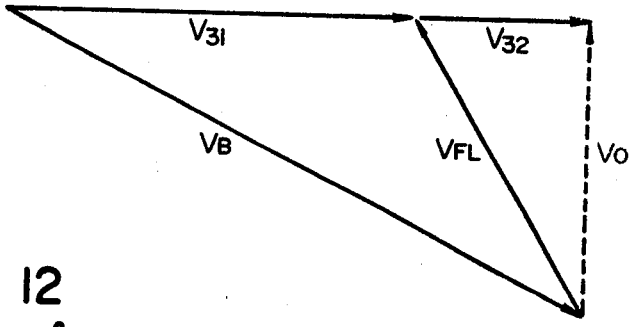
Figure 12:
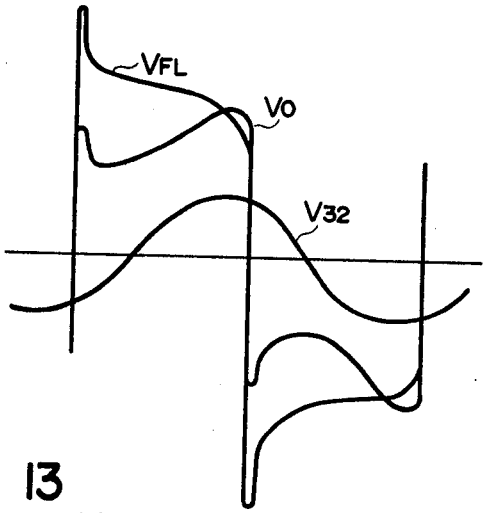
Figure 13:
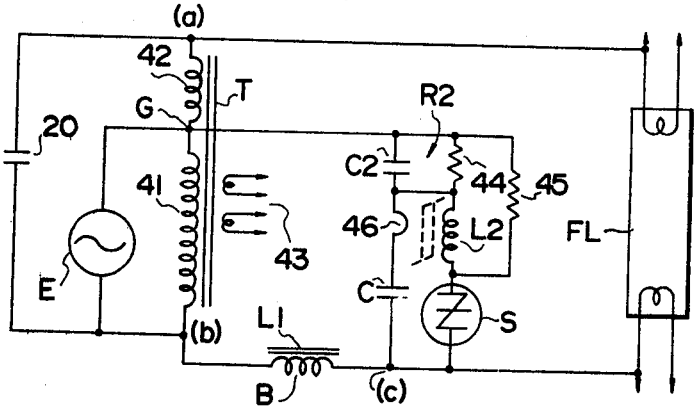
Figure 14:
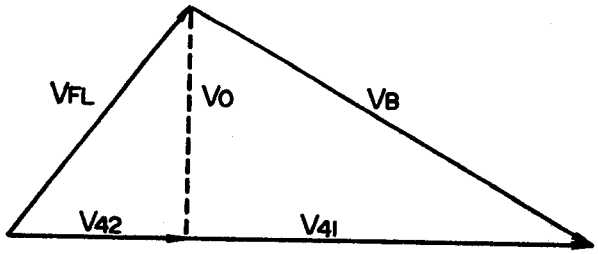
Figure 15:
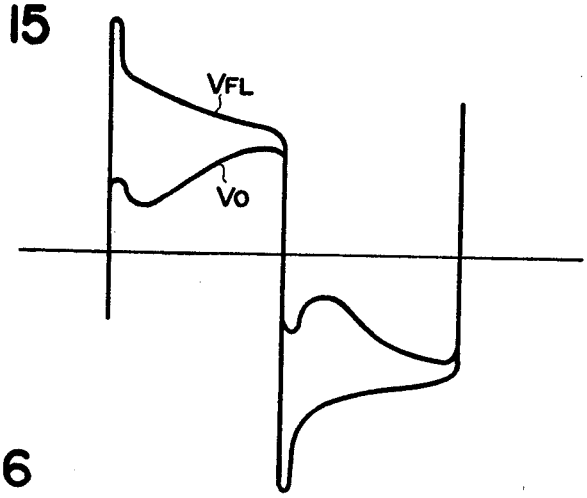
Figure 16:
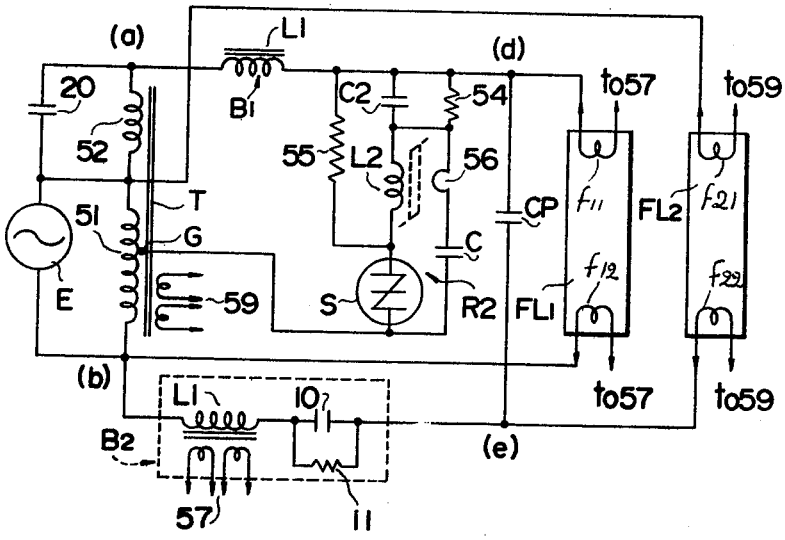
Figure 17:
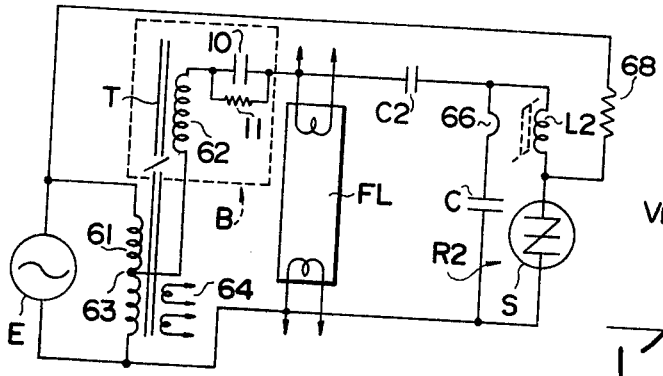
Figure 18:
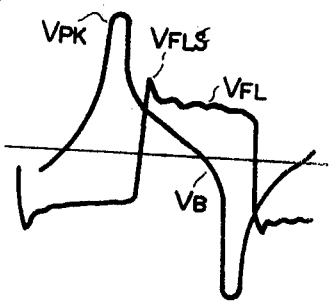
Figure 19:
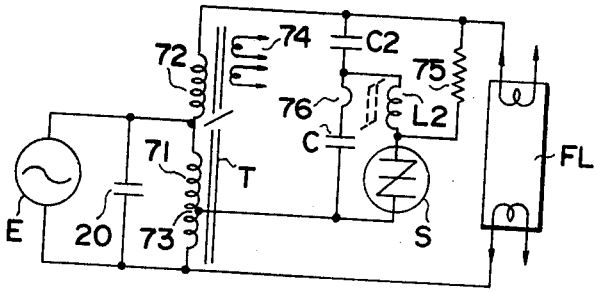
Figure 21:
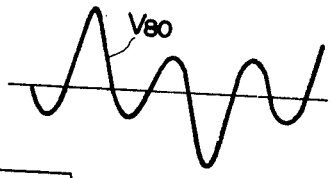
Figure 20:
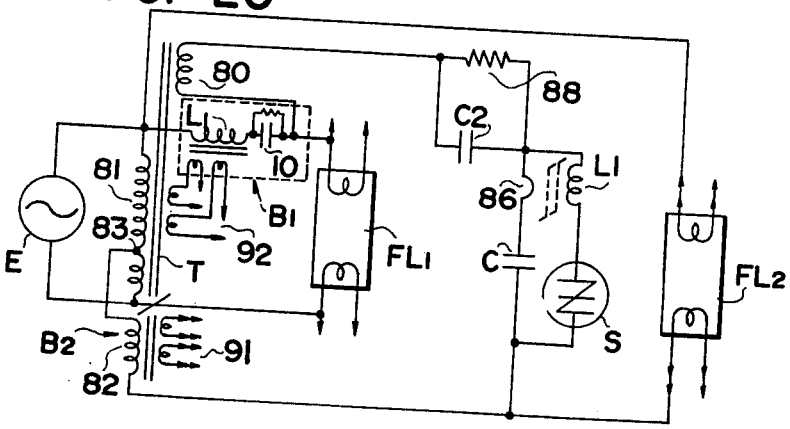

FIGS. 3(A) and 3(B) are graphs illustrating the operation of the backswing booster of FIG. 1;

FIG. 4 is a timing diagram illustrating the operation of the backswing booster;

FIG. 5 is a circuit diagram of a modification of FIG. 1 in which a high output voltage with an intermittent oscillation is generated, wherein the circuit arrangement has a relatively small volt-ampere capacity;

FIG. 6 is a graph illustrating the operation of the backswing booster of FIG. 5;

FIG. 7 is a fundamental block diagram of a lighting device using the backswing booster of FIG. 1 in accordance with the present invention;

FIG. 8 is a circuit diagram illustrating an embodiment of a lighting device for a plurality of discharge lamps, in which the total lamp voltage of the lamps, which are connected in series, is close to the power source voltage;

FIG. 9 is a circuit diagram illustrating an embodiment of a lighting device for two discharge lamps, which employs a single high voltage generating circuit for the backswing booster for starting two discharge lamps and which controls the filament voltage of the discharge lamp during lamp operation;

FIG. 10 illustrates a circuit diagram of a discharge lamp lighting device using the backswing booster of FIG. 5, in which the voltage applied to the high voltage generating circuit is reduced, during lamp operation, by means of a supplemental winding of the transformer;

FIG. 11 is a vector diagram of the peak voltage values during lamp operation in the circuit of FIG. 10;

FIG. 12 shows the voltage waveforms for the main elements of FIG. 10 during lamp operation;

FIG. 13 is a circuit diagram of a modification of FIG. 10;

FIG. 14 is a vector diagram for the peak voltage values of FIG. 13 during lamp operation;

FIG. 15 shows the voltage waveforms for the main elements of FIG. 13 during lamp operation;

FIG. 16 is a circuit diagram of another embodiment of FIG. 13, in which two discharge lamps are operated by one high voltage generating circuit;

FIG. 17 is a circuit diagram illustrating another embodiment of a discharge lamp lighting device using a lead peak type leakage transformer as a ballast, the saturation period of which is controlled to reduce the peak of the lamp voltage during lamp operation;

FIG. 18 shows the waveforms of FIG. 17, during lamp operation;

FIG. 19 is a circuit diagram illustrating a further embodiment of a lag phase lighting device for a discharge lamp using a leakage transformer as a ballast;

FIG. 20 is a circuit diagram illustrating a still further embodiment of a flickerless high power factor lighting device for two discharge lamps in accordance with the present invention, in which the output voltage of the high voltage generating circuit is reduced by means of a voltage offsetting in the lead and lag phase of the lamp voltages; and FIG. 21 shows the induced voltage waveform of harmonics during operation of the circuit of FIG. 20.

DETAILED DESCRIPTION OF PREFERRED EMBODIMENTS

FIG. 1 shows a circuit diagram of the oscillator which is also employed in the present invention as a backswing booster. In FIG. 1 a first oscillation circuit R1 comprises a power source E, a linear inductor L1 such as a choke coil, an oscillating capacitor C and a power switch SW connected in series with a power source E. A second oscillation circuit R2 is formed of a series circuit which comprises a saturable nonlinear inductor L2 and a bi-directional two terminal switching element operative in response to a voltage, and connected in parallel with the capacitor C. A third oscillation circuit R3 comprises an inductor L2 and a capacitance element such as its distributed capacity C1. The inductor L2 has such characteristics that its inductance decreases with an increase of the current flowing therethrough, and that it is magnetically saturated when the magnetic flux through the core exceeds a certain value. These characteristics are attainable by the use of a magnetic material, such as Mn-Zn type ferrite which is also dielectric. In this circuit arrangement, the first oscillation circuit is called a power source circuit, and the second and third oscillation circuits are called high voltage generating circuits.

Figure 2:
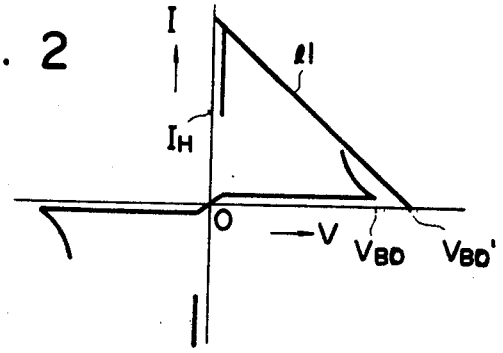
FIG. 2 is a graph of a voltage response characteristic of the switching semiconductor in the backswing booster of FIG. 1.

FIG. 2 shows a voltage-current characteristic of a typical bidirectional two terminal switching semiconductor S advantageously used in the oscillator of FIG. 1. These characteristics and respective semiconductors are well known to those skilled in the art and hence a detailed explanation thereof will be omitted. The oscillation period of the second oscillation circuit or high voltage generating circuit R2 is chosen to be smaller than that of the first oscillation circuit R1 at the moment of saturation of the inductor L2. The distributed capacity C1 of the inductor L2 is shown in FIG. 1 as an equivalent connected in parallel with the inductor L2, while the equivalent loss resistance r1 of the inductor L2 is also shown therein connected in parallel with the inductor L2. For an optimum operation of the backswing booster it has been found, according to the invention, to be useful to connect a small capacitor in parallel with the inductor L2.

Figure 3:
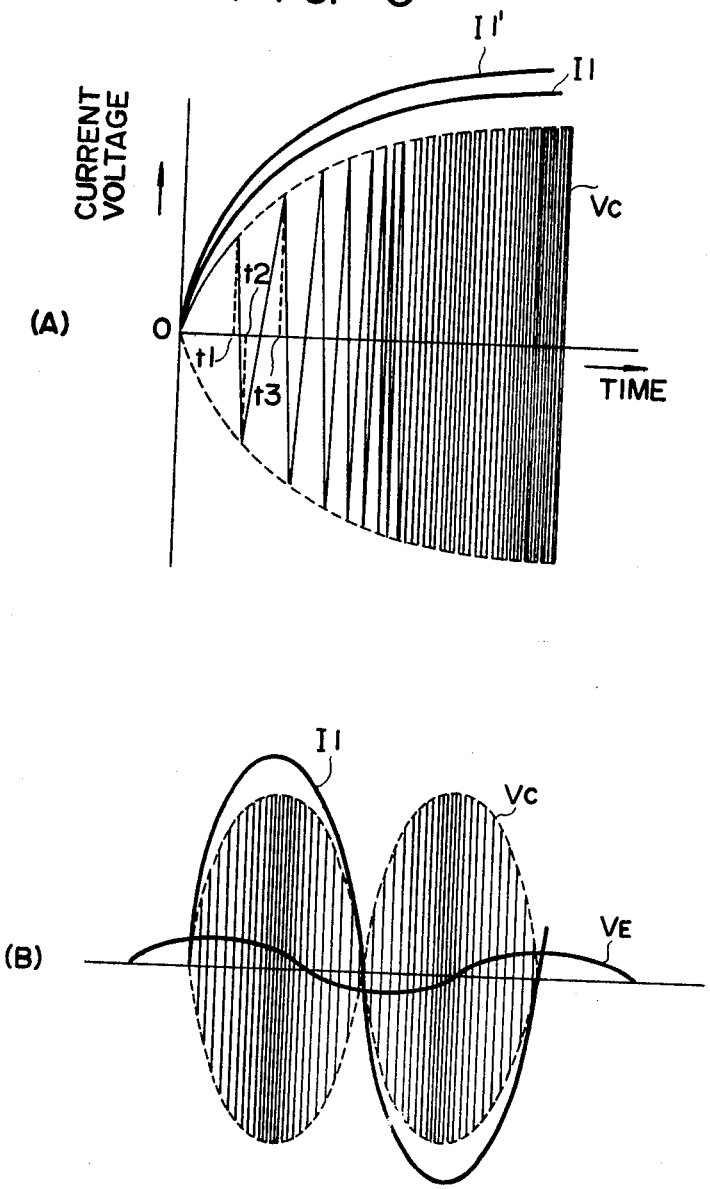

FIG. 3 (A) shows the voltage VC generated by the circuit R2 between both ends of the capacitor C in case where a direct current (DC) power source E is employed as the power source. FIG. 3 (B) shows the similar voltage VC but with an alternating current (AC) power source.

FIG. 4 shows the relationship of the voltage VC across the capacitor C, the current IC through the capacitor C, the output voltage VE from the DC voltage source E and the backswing voltage VL2 across the inductor L2 on an enlarged scale along the time axis when the oscillation has been stabilized.

Referring now to these figures, an initial sequence in the operation of the apparatus is a charging mode of operation in which the switch SW is closed to charge the capacitor C and thus the voltage VC across the capacitor C applied to the switching semiconductor S through the inductor L2 increases.

When the voltage VC has exceeded the breakdown voltage VBO of the switching semiconductor S (as at the time $t1$ in FIG. 3A), the switching semiconductor S is turned on and the capacitor C is discharged since the inductor L2 practically does not have any substantial impedance at such a low frequency voltage variation. In this way, a discharge mode of operation begins. The discharge current IC through the capacitor C increases in a cosine wave pattern with respect to the decrease of the voltage VC, i.e. in a sine wave pattern advanced by about $\pi/2$, and then starts decreasing, see FIG. 4. The current IC reaches a very high level due to the saturation of the inductor L2 when the quality factor Q of the second oscillation or high voltage generating circuit R2 is high. The inductance 1s of the inductor L2 is extremely small when L2 is saturated, as compared to its inductance 1u at a moment of non-saturation. The current IC decreases with the progress of the discharge of the capacitor C and thus the current I2 through the switching semiconductor S decreases. Thus, the current I2 represents the sum of the discharge current IC from the capacitor C and the current I1 through the switching semiconductor S when the switching semiconductor S is turned on. The current I1 is supplied from the power source E through the path E-L1-L2-S-E. The current I1 in an early stage increases very slowly because of the large inductance of the linear inductor L1 and is small enough to be neglected. Hence, the switching element S is turned off when the current I2 has decreased to zero. While the switching semiconductor S is kept on, the electric charge of the capacitor C is transferred and thus the voltage VC is inverted in polarity to become slightly higher than −VBO because of the voltage drop caused by the resistance r1. This, however, does not mean that the switching element S is immediately turned on in an opposite direction. Since, when the switching semiconductor S is on, the capacitor C and the distributed capacity C1 of the inductor L2 are connected in parallel, the distributed capacity C1 is at the same time charged to the same voltage in the same polarity as the capacitor C, its voltage thus being about −VBO. Thus, the inductor L2 is restored to be in the unsaturated condition when the switching semiconductor S is turned off or blocked.

With the switching semiconductor S off, a new charging mode of operation begins in the first oscillation circuit R1. The initial value of a primary current I3 flowing through the inductor L1 cannot be zero in this mode of operation, which is different from the initial charging mode of operation, since the initial value of the primary current I3 is still present immediately before the electromagnetic energy stored in the inductor L1 turns off the switching semiconductor S in the previous discharging mode of operation. In addition, the normal current I4 having the same value as in the initial charging mode of operation flows to charge the capacitor C. As a result, the current I1 for charging the capacitor C is the sum of both the primary current I3 and the normal current I4. The oscillating operation of the inductor L1 and the capacitor C causes the capacitor C to be charged again, and thus the voltage VC continues increasing from −VBO through a zero-volt line to and above +VBO. Meanwhile, the switching semiconductor S is kept non-conductive even if VC has increased above +VBO because during the previous discharging operation electrostatic energy is stored in the distributed capacity C1 of the inductor L2. More specifically, even after the switching semiconductor S is turned off and thus the current I2 through the switching semiconductor S is cut off and the inductor L2 is again in the non-saturated condition, the electrostatic energy stored in the distributed capacity C1 is transferred, so that the backswing voltage VL2 as shown in FIG. 4 is generated across the inductor L2 in a direction opposite to that of the voltage VC across the capacitor C. Thus, a damped oscillation is started which is caused by the inductance 1u in the non-saturating condition of the inductor L2 and the distributed capacity C1. Consequently, the terminal voltage of the inductor L2 remains as it is for a relatively long time period which is longer than the time period of $t2$ to $t3$ as shown in FIG. 3 (A).

The direction of the discharge current IC′ from the distributed capacity C1 is opposite to that of the discharge current IC of the capacitor C with respect to the inductor L2, and hence the inductor L2 is quickly restored to the unsaturated condition. By proper choice of the construction of the inductor L2, it is possible through adjustment of the oscillating operation caused by the inductor L1 and the capacitor C in the first oscillation circuit R1, to make the variation rate of the backswing voltage VL2 similar to that of the terminal voltage VC caused by recharging of the capacitor C. In such a case, the terminal voltage across the switching semiconductor S determined by the difference between the voltage VC and the voltage VL2 is kept low for a considerably long time despite the rise of the terminal voltage VC of the capacitor C. While the backswing voltage VL2 attenuates in a damped oscillation, as mentioned above, and as a result a difference voltage between the terminal voltage VC of the capacitor C and the backswing voltage VL2 continues increasing gradually until the difference voltage is equal to VBO and at this moment the switching semiconductor S is turned on again. Thus, the charging and discharging modes of operation are alternately repeated.

As a result, each time the capacitor C is charged the normal capacitor charging current I4 is added to the primary current I3 through the first oscillation circuit R1, and each time the capacitor C is discharged the primary current I3 passing through the loop E-L1-L2-S-E continues increasing gradually, whereby the capacitor charging current I1 also continues increasing gradually, so that the time period of the charging mode of operation is shortened as the charging is repeated.

Meanwhile, as mentioned above, the primary current I3 flowing through the loop E-L1-L2-S-E continues increasing in each discharging mode, and the terminal voltage VC of the capacitor C increases immediately before the switching semiconductor S is turned on. Consequently, the current I2 through the inductor L2 increases gradually. As a result, the amount of electrostatic energy stored in the distributed capacity C1 increases and thus the backswing voltage VL2 across the inductor L2 which is generated by the oscillation circuit R3 when the switching semiconductor S is turned off, also increases.

Thus, the voltage VC is amplified in the charging mode and inverted in the discharging mode. The backswing voltage VL2 is amplified in the discharging mode. Hence VC gradually increases thus $VC = VBO + VL2$ until eventually the voltage VL2 can follow the voltage VC at its extreme. In this stabilized condition, the primary current I3 remains constant, and is only slightly lower than the current I1 stabilized in the circuit shown in FIG. 1 with the capacitor C eliminated and the switching semiconductor S short-circuited. The oscillation period is determined by the voltage VC under this stabilized condition.

In this way, the modes of operation described above are repeated and the circuit shown in FIG. 1 oscillates to provide an alternating current (AC) output, as illustrated in FIG. 3 (A). Eventually, the oscillation output voltage VC follows such a pattern that the envelope saturates at a value determined by the circuit constants.

Thus, an AC voltage VC of high frequency is generated across the capacitor C, which is higher than that of the DC voltage source E. The oscillation frequency attainable in the embodiment of the invention is up to several tens KHz and the oscillation voltage is up to nearly 10 times the source voltage and the oscillation current I2 is up to two or three times the current I1.

It is to be understood that an AC power source may be used as the power source E in view of the high oscillation frequency. In such a case, as seen from FIG. 3 (B), the envelope of the oscillating output voltage VC follows a sine curve which is in phase with the AC input current I1, and is out of phase by about 90° with an AC voltage VE of the AC power source E, and is symmetrical with respect to the time axis.

The above function is achieved also in case where a capacitor is connected in series with the linear inductor L1 and thus the series capacitor and the linear inductor L1 cooperate as a so called advanced-phase current limiting circuit.

FIG. 5 shows a modification of FIG. 1, in which high frequency and high voltage in intermittent oscillation is generated from the output terminals To of the high voltage generating circuit. FIG. 6 shows the voltage VC generated by the circuit R2 of FIG. 5, in which an impedance circuit having a capacitor C2 for limiting the current is added to the high voltage generating circuit R2, for instance, between the capacitor C and the linear inductor L1. In this case, since the input current I1 flows intermittently as shown in FIG. 6, a momentary high voltage output may be obtained by a small current from the circuit R2 providing reduced volt-ampere capacity. This intermittent oscillation appears at the output terminals To. When the switching semiconductor S turns on by applying different voltages between the source voltage VE and the voltage VC2 across the second capacitor C2, the voltage VC2 is rapidly reversed to $-VC2$ and remains as it is for a half cycle. Since the switching semiconductor S turns off if $VE-VC2 < VBO$ during the next half cycle, the source voltage VE is offset as $-VC$. For obtaining the same effects, the capacitor C2 in the impedance circuit is also connected between the capacitor C and the nonlinear inductor L2 in the second oscillation or high voltage generating circuit R2.

The discharge lamp lighting device of the present invention utilizes the high voltage oscillation output VC generated across the capacitor C or output terminals To in the oscillating and high voltage generating circuit R2 shown in FIG. 1 or in FIG. 5.

In accordance with this invention, the backswing booster as shown in FIG. 1 or in FIG. 5 are employed in combination with a given ballast as part of the lamp operating circuit arrangement. In a discharge lamp lighting device of the present invention, the output of the high voltage generating circuit or backswing booster starts the lamp, whereby the terminal voltage of the ballast is maintained as low as possible and the voltage of the power source is kept close to the lamp voltage across the discharge lamp.

FIG. 7 shows a basic block diagram of a circuit arrangement for lighting a single discharge lamp FL in accordance with the present invention. The discharge lamp FL is connected across the capacitor C with its filaments f1 and f2 connected in series with the second oscillation or high voltage generating circuit R2. The essential features of the backswing booster are the same as those of the circuit shown in FIG. 1, and therefore like parts are designated by like reference characters. For the purpose of simplicity, the distributed capacity of C1 and the equivalent loss resistance r1 of the nonlinear inductor L2 in the third oscillation circuit R3 are omitted from the figures to be described below.

In FIG. 7, however, a small capacitor C3 is connected across the nonlinear inductor L2 to obtain the optimum condition for the third oscillation circuit R3 and to generate the output voltage efficiently. The capacitance of capacitor C3 is chosen to increase the amplitude of the backswing voltage VL2 as shown in FIG. 4.

In FIG. 2 the load curve l1 is shown additionally for a better understanding of the operation of the device shown in FIG. 7, which will be described in the following with reference to FIG. 2.

The maximum instantaneous voltage VMAX at the output of the power source E, the peak value VFL of the voltage applied across the discharge lamp FL referred to as "spike voltage VFLS" or "reingition voltage in each half cycle" which may be higher at low ambient temperature, the breakdown voltage VBO of the switching semiconductor S and the effective breakdown voltage VBO' of the switching semiconductor S during the lighting operation of the discharge lamp FL against the reignition voltage or spike voltage of high frequency, are chosen so as to meet the following relationships.

$$VMAX > VBO$$

and $$VBO' > VFL$$

In the embodiment of FIG. 7, the AC power source E may have the standard line frequency. Thus, the impedance of the non-linear inductor L2 is almost negligibly small at the time of starting of the discharge lamp FL. Due to the relationship $VMAX > VBO'$ the oscillation is started with turning on of the power switch and accordingly a high voltage VC is applied across the capacitor C. Meanwhile, the filaments f1 and f2 of the discharge lamp FL are preheated by a large high frequency current, as described above, by means of the second oscillation or high voltage generating circuit R2. After sufficient preheating of the filaments f1 and f2 the discharge lamp FL is started or turned on by applying the high oscillation voltage, and then even though a large amplitude spike voltage is generated the oscillation is terminated because of the relationship $VBO' > VFL$, and the discharge lamp FL continues discharging. When the discharge lamp FL remains lighted, a ballast B including the linear inductor L1 performs the function of a current limiter while the capacitor C serves as a noise eliminator.

In the device of FIG. 7, the voltage across the ballast B is maintained as low as possible whereby the differential voltage between the source voltage VE of the power source E and the lamp voltage VFL of the discharge lamp FL is kept near zero. If VE is 200 volts, VFL is 100 volts, and FL is a fluorescent lamp of a 40 watt preheat type, the terminal voltage VB of the ballast B may be maintained at about 150 volts due to the phase shift and the lag phase lamp current. It is the aim of the present invention to provide a low terminal voltage across the ballast B, whereby a small size or miniature ballast may be used. In other words, this is achieved by making the voltage VE of the power source E substantially equal to the lamp voltage of the discharge lamp or by enhancing the power factor of the discharge lamp lighting device.

FIG. 8 illustrates a circuit arrangement of a discharge lamp lighting device for a plurality of discharge lamps. For two discharge lamps, the lighting device comprises first and second discharge lamps FL1 and FL2 in series connection, a power source circuit having a power source E and an advanced choke ballast B in series, first and second high voltage generating circuits R21 and R22, as well as a second oscillation circuit in the back-swing booster of FIG. 1, and impedance means 16 between the second discharge lamp FL2. The ballast B comprises a series circuit of a choke coil L1 having a linear inductance characteristic, and a phase advancing capacitor 10 with a parallel discharging resistor 11. In this case, voltage compensating means may be added for regulating the voltage of the power source E. Each of the high voltage generating circuits R21 and R22 comprises a capacitor C for oscillation and noise prevention, a nonlinear inductor L2 and a switching semiconductor S of the bi-directional diode thyristor type, hereinafter called a "thyristor". However, the capacitor C in the second high voltage generating circuit R22 may be removed if desired.

For instance, the power source E may have a source voltage of 200 volts, and the first and second discharge lamps may respectively be a 40 watt circular fluorescent lamp FL1 and a 20 watt circular fluorescent lamp FL2. Each nonlinear inductor L2 is formed by a common magnetic core 12 to which a bias coil 14 is coupled magnetically. While the bias coil 14 is coupled electrically to the charging path of the capacitor C in the second high voltage generating circuit R22, the magnetic flux density varies in response to the exciting current through the bias coil 14. As an improvement of this circuit, impedance means such as a resistor 16 is connected across the second discharge lamp FL2 through the non-linear inductor L2 or across the thyristor S in the second high voltage generating circuit R22 to provide a desired impedance for the second high voltage generating circuit R22 when the thyristor S is not conducting.

In this arrangement the total lamp voltage of the discharge lamps FL1 and FL2 connected in series is about 160 volts. Thus, the terminal voltage of the ballast B will be lower than that of FIG. 7, and an improved power factor will also result, whereby the breakdown voltage VBO of the thyristor S in the first high voltage generating circuit R21 must be higher than the lamp voltage exclusive of any spike voltage the first discharge lamp FL1 and the breakdown voltage VBO of the thyristor S in the second high voltage generating circuit R22 must also be higher than the lamp voltage exclusive of any spike voltage across the second discharge lamp FL2. Thus, the total of the breakdown voltages of each thyristor S exceeds the maximum instantaneous voltage VE of the power source E in the power supply circuit. The resistor 16 resolves this problem, because the resistor 16 first causes the breakdown of the thyristor S in the first high voltage generating circuit R21, and then the breakdown of the thyristor S in the second high voltage generating circuit R22 sequentially due to charging of capacitor C. Alternatively, the function of resistor 16 may be achieved by using different capacities of the capacitors in the high voltage generating circuits R21 and R22. In such a case, the thyristor S of the circuit having the smaller capacitance of the capacitor C to which the higher divided voltage is applied, will first turn on.

FIG. 9 illustrates a circuit arrangement of a lighting device according to the invention for two discharge lamps, which uses a single high voltage generating circuit R2 as shown in FIG. 1. The device comprises a power source E such as 200 volts and 50 Hz, a first series circuit with a first 40 watt fluorescent discharge lamp FL1 and a first ballast B1, a second series circuit with a second 40 watt fluorescent discharge lamp FL2 and a second ballast B2, and the high voltage generating circuit R2. Each fluorescent lamp FL1 and FL2 has filaments which are heated by a different system in this embodiment of the invention. These filaments are not necessary for the purpose of this invention, but it is preferred to have at least one filament in the second discharge lamp FL2. This circuit further includes a capacitor 20 such as of 9$\mu$ F for improving the power factor and connected across the power source E, a pair of secondary windings 22 of the first ballast B1, a pair of secondary windings 24 of the second ballast B2, a capacitor 26 connected between the filaments of the second discharge lamp FL2, a first bias coil 28 electrically connected in the high voltage generating circuit R2 and coupled magnetically to the nonlinear inductor L2, and a second bias coil 29 electrically connected in series with the second discharge lamp FL2 and coupled magnetically with the nonlinear inductor L2. Each pair of secondary windings 22 is used for heating the filaments of the second discharge lamp FL2. The capacitor 26 adjusts the supply voltage for the second discharge lamp FL2. It is an important feature of this invention to use the first bias coil 28 for suppressing the output of high voltage and delaying the ignition of the first discharge lamp FL1, and/or to use the second bias coil 29 for plus-biasing the nonlinear inductor L2 and releasing the suppression of the first bias coil 28 by checking the current when the second discharge lamp FL2 is lighted. These bias coils 28, 29 may be used singly or in combination.

The device of FIG. 9 operates as follows. When the voltage VE of the power source E is switched on, the output of the high voltage generating circuit R2 is applied to the first discharge lamp FL1 for preheating its filaments. A high frequency breakdown current flows in the filaments of the first discharge lamp FL1 and the first bias coil 28, so that a closed circuit of C-FL1-28 is formed when the thyristor S is conducting. Since the first bias coil 28 is magnetically coupled tightly with the nonlinear inductor L2, the output of the high voltage generating circuit R2 is substantially suppressed and the ignition or starting of the first discharge lamp FL1 is inhibited for a while due to resistance loss in the discharge. Meanwhile, the source voltage VE and the oscillating high voltage VC are applied through the second ballast B2 to the second discharge lamp FL2, wherein the high frequency oscillating high voltage generated in the high voltage generating circuit R2 is transferred by the pairs of secondary windings 22 and 24 to the capacitor 26 the terminal voltage of which is applied across the second discharge lamp. Since a part of the high frequency voltage is absorbed in the capacitor 26, the suitable value of voltage will be applied to the second discharge lamp FL2 to start it first. As the second discharge lamp FL2 is lighted, the second bias coil 29 through which the lamp current flows, excites the nonlinear inductor L2 in a positive biasing manner to increase the range of magnetic flux density changes. The magnetic level of the nonlinear inductor L2 due to the second bias coil 28 is chosen to be superior to the level due to the first bias coil 29 so as to release the function of suppressing the output of the high voltage generating circuit R2. As a result, the first discharge lamp FL1 is started second by selection of the bias effects of the first and second bias coils 28 and 29. The above arrangement of the bias coils 28 and 29 may be modified by a series connection of their reversed windings. In this case, winding turns of each bias coils 28 and 29 will give a small plus bias to the nonlinear inductor L2 when the discharge lamp FL1 is lighted. In other words, the bias coil 28 as well as the bias coil 29 are provided with many turns and as a result, the function of the bias coil 28 will be completely achieved as a result of the suitable plus-bias effect of the bias coil 29, and without any over plus-bias effect.

In the operation of the first and second discharge lamps FL1 and FL2, the voltage applied to the filaments of the second discharge lamp FL2 may be decreased by the arrangement of the secondary windings 22 and 24 and the capacitor 26, in order to reduce power loss and to improve lamp life. This is similar to the device of FIG. 7 having a parallel circuit, however in FIG. 9 two discharge lamps are operated by means of only one high voltage generating circuit.

FIG. 10 illustrates a circuit arrangement of a discharge lamp operating device which satisfies the foregoing requirements and uses a high voltage generating circuit R2 having an impedance circuit in the backswing booster as shown in FIG. 5. In this case, a high frequency high voltage generated in intermittent oscillation by the high voltage generating circuit R2 is applied to the discharge lamp. This device comprises two series circuits, one of which includes a primary winding 31 of a voltage transformer T, a discharge lamp FL, and a lead phase ballast B having a linear inductor L2 and a phase advancing capacitor 10 with a discharging resistor 11. The other series circuit includes a high voltage generating circuit R2 and an impedance circuit having a capacitor C2 of 0.47μF and a discharging resistor 34 of 33kΩ in parallel, and is connected between the terminal of a supplemental winding 32 of small current capacity added to the primary winding 31, and the connecting point between the ballast B and the discharge lamp FL. The capacity values for the phase advancing capacitor 10, a capacitor C2 in the impedance circuit and a capacitor C in the high voltage generating circuit R2 are selected in the relation of $C10 > C2 > C$.

In this arrangement, when an a.c. power source E of 200 volts and 50 Hz is connected, the filaments f1 and f2 of the discharge lamp FL, which may be a 110 watt rapid type fluorescent lamp, are heated by voltages induced in the filament windings 33 of the transformer T. At the same time, the induced voltage V31 of the primary winding 31 and the induced voltage V32 of the supplemental winding 32 are added and supplied to the series circuit of the impedance circuit and the high voltage generating circuit R2. The primary winding 31 is useful for the power factor correction.

Due to the above relation of $C10 > C2 > C$ the capacitor C in the high voltage generating circuit R2 is charged to an extent approximately equivalent to the above described added voltage, and the thyristor S becomes conductive due to said added voltage to initiate the oscillating operation of the high voltage generating circuit R2.

This oscillating operation which involves the so called backswing voltage boosting effect, generates a high frequency, high voltage across the capacitor C, which voltage is applied to the discharge lamp FL through the impedance circuit and the supplemental winding 32. When the capacitor C2 in the impedance circuit is to be charged in each half cycle of the power source voltage by the oscillating operations of the high voltage generating circuit R2, its terminal voltage rapidly increases and therefore the divided voltage of the capacitor C rapidly decreases so as to stop the oscillating operation of the high voltage generating circuit R2 at a certain step as described above with reference to FIG. 5. The generated high frequency, high voltage VC has, as shown in FIG. 6, an oscillation waveform which appears intermittently in every half cycle of the power source voltage VE. For instance, the voltage VC has a peak of 1100 volts.

When the filaments f1 and f2 are sufficiently heated, the discharge lamp FL is rapidly started by the high frequency, high voltage VC. An approximate vector diagram of the lighted lamp operation is illustrated in FIG. 11 and shows the peaked terminal voltages VFL and VB of the discharge lamp FL and of the lead phase ballast B respectively. VO is the peak voltage applied to the series circuit of the high voltage generating circuit R2 and the impedance circuit during the operation of the discharge lamp FL. The voltage VO becomes the voltage applied substantially to the high voltage generating circuit R2 due to the above mentioned relation of $C2 > C$.

In the circuit arrangement of FIG. 10, the resistor 38 of 47kΩ increases the amplitude of the high frequency, high voltage VC due to the positive bias function of the positive part of input current. In other words, the resistor 38 serves to raise the voltage across the thyristor S at the time of starting, for instance, by about 367 volts of peak voltage, but to reduce the spike voltage during lamp operation by reason of the lead phase lamp voltage of about 60 degrees. When the voltage across the capacitor C2 would be maintained during operation, the thyristor S will be overloaded by the increased voltage across the thyristor S. To prevent such overloading the discharging resistor 34 across the capacitor C2 is necessary. While the resistor 38 serves to charge the capacitor C2 through the nonlinear inductor L2, such charged voltage is also useful to reduce the voltage applied to the thyristor S. Thus, said reduction is necessary for preventing the misoperation of the high voltage generating circuit R2 at low temperatures by preventing a charging of the capacitor C2 during the lamp operation, in cooperation with the discharging resistor 34.

As may be seen from FIG. 11, the voltage applied to the high voltage generating circuit R2 is high, when the discharge lamp FL starts, because of the adding of the induced voltages V31 of the primary winding 31 of the transformer T, and V32 of the supplemental winding 32. However, during the lamp operation the voltage is reduced to VO by vectorially offsetting or compensating the terminal voltage VFL of the discharge lamp FL.

It may also be seen from FIG. 12, which shows the instantaneous values of half cycle voltage VFL and VO corresponding to the discharge lamp FL and the high voltage generating circuit R2 during the lamp operations, that said VO is controlled at a lower voltage than the terminal voltage VFL of the discharge lamp. FIG. 12 illustrates the voltage waveforms in relation to the terminal voltage V32 of the supplemental winding 32 which is used for compensating the spike voltage of the lamp voltages VFL which includes a spike portion, and the voltage VO for starting. The output voltage VO is the vectorial sum of VFL and V32, whereby the upstanding or positive portion of the voltage VO may be suppressed. In this arrangement, since the lamp voltage VFL is about 170 volts, the ballast B may be miniaturized significantly by diminishing its terminal voltage with a relatively high power factor. In practice, the ballast B of this invention may have a weight corresponding to about one half and a power loss corresponding to about two thirds of a conventional ballast.

Consequently, the voltage which initiates the conduction of the thyristor S in the high voltage generating circuit R2, i.e. the breakdown voltage VBO is selected within a range above the applied voltage for the high voltage generating circuit R2 during operation and below the maximum applied voltage for the high voltage generating circuit R2 at the time of starting. In other words, by using a thyristor S having a breakdown voltage VBO within the above range such as say 300 volts, the above mentioned lighting device may be properly operated.

If the power supply voltage E has 200 volts and the supplemental winding 32 has an induced voltage of 100 volts in the discharge lamp lighting device of FIG. 10, it has been found that the maximum voltage applied to the high voltage generating circuit R2 reaches about 367 volts at starting and about 250 volts during the lamp operation. These values were measured at normal temperature. However, when a lower temperature is involved at which the terminal voltage of the discharge lamp FL rises substantially, particularly the spike voltage at the positive portion of the waveform rises sharply at lower temperatures, the voltage applied to the high voltage generating circuit R2 during the lamp operation will also rise higher, for example to 300 volts in its low frequency component and to 400 volts in its spike voltage component. Therefore, the thyristor S must have a breakdown voltage VBO of about 300 volts. However, since the breakdown voltage VBO of commercial thyristors is only about 100 volts, it is necessary to use three thyristors S in series.

FIG. 13 shows an improved circuit arrangement of a discharge lamp lighting device where the symbols of the same parts as in FIG. 10 are referred to by the same symbols. This device of FIG. 13 has the advantages of reducing the required breakdown voltage and hence the necessary number of thyristors. It may also be operated at power supply voltages other than 200 volts. In FIG. 13 the lag phase ballast B of the linear inductor L1 and the discharge lamp FL are connected as a series circuit between the output terminals (a) and (b) of the transformer T.

A power factor improving capacitor 20 is connected across these terminals to permit making the transformer T as small as possible for reducing the lag current in the primary winding 41 by the lead current and for reducing the current capacity of the secondary winding 42. The impedance and high voltage generating circuit R2 is connected as a series circuit between the point (c) of the lag phase ballast B and the discharge lamp FL, and the potential point G on the transformer T.

The position of the potential point G is so selected that the following two conditions are satisfied. First, at starting the high voltage generating circuit R2 generates an oscillating high voltage sufficient to start the discharge lamp FL. This starting voltage is a higher voltage than the power souce voltage. Second, when the discharge lamp FL is lighted, the voltage to the high voltage generating circuit R2 is vectorially offset or compensated and is insufficient to start the oscillation operation. The high voltage generating circuit R2 is formed as parallel circuits comprising a series circuit of a thyristor S and a nonlinear inductor L2 and a series circuit of a capacitor C and a bias coil 46 which is magnetically coupled to the non-linear inductor L2 in order to give a magnetic bias, a so called positive bias for increasing the range of magnetic flux density changes of the inductor L2. The high voltage generating circuit R2 generates a high voltage as follows. When the voltage of the a.c. power source E is connected to the high voltage generating circuit R2, the capacitor C is charged whereby its terminal voltage increases. When the instantaneous value of the voltage reaches the breakdown voltage VBO of the thyristor S, the thyristor S becomes conductive and the charge of the capacitor C is discharged through the closed circuit: C-46-L2-S-C.

Since the nonlinear inductor L2 is saturated by the discharging current and this current is gradually reduced from the large peak value, the thyristor S turns off and becomes non-conducting when the instantaneous discharging current becomes zero.

As the Q of the closed discharging circuit is high at this moment, the terminal voltage of the capacitor is kept at nearly −VBO. Meanwhile by turning off the thyristor S, the so called backswing voltage is induced on the basis of the energy stored in the nonlinear inductors L2 and its parallel capacitor, if a capacitor should be used. As the polarity of the backswing voltage is reduced to the terminal voltage of the capacitor C, the differential voltage is applied to the thyristor S. This differential voltage is lower than the breakdown voltage VBO of the thyristor S and thus the non-conduction of the thyristor is maintained. Immediately thereafter the capacitor C is charged by the addition of the terminal voltage of the capacitor C and the instantaneous voltage of the power source E. The terminal voltage of the capacitor C′ changes from −VBO to zero and increases to the next positive peak value. However, when the terminal voltage of the capacitor C reaches the VBO value at which the thyristor S turned on in the preceding cycle, at this time, the thyristor S remains in the non-conducting state because the nonlinear inductor L2 induces the backswing voltage and the terminal voltage of the thyristor S does not reach the breakdown voltage VBO. However, the differential voltage due to the varying ratio of the backswing voltage and the terminal voltage of the charged capacitor C increases gradually and when it reaches the breakdown voltage of the thyristor S the latter turns on again to discharge in the closed circuit. These operations are repeated due to the change of the instantaneous voltage of the power source so that a high frequency, high voltage VC is generated across the terminals of the capacitor C. In this case, the bias coil 46 provides a magnetic bias to increase the range of the magnetic flux density changes in the nonlinear inductor L2 by the current flowing therethrough for charging of the capacitor C, and hence the backswing voltage of the nonlinear inductor L2 increases further. Consequently, the amplitude of the high frequency, high voltage across the terminals of the capacitor C is further increased.

Further, since capacitances of the capacitor C and of the capacitor C2 in the impedance circuit have the relation C2 > C, the capacitor C2 is rapidly charged as the oscillating operation proceeds so as to elevate the terminal voltage of the capacitor C2 and to reduce the terminal voltage of the capacitor C correspondingly. Therefore, the differential voltage of the terminal voltage of the capacitor C and the backswing voltage of the nonlinear inductor L2 cannot ever reach to the breakdown voltage VBO of the thyristor as the oscillating operation continues and the high voltage generating circuit R2 stops to generate the high frequency, high voltage VC as described hereinbefore. As a result VC has a waveform of intermittent oscillation as shown in FIG. 6. Also, the resistor 45, which is connected across the series circuit of the capacitor C2 and the nonlinear inductor L2, functions to reduce the power loss of the parallel resistor 44 by decreasing the terminal voltage of the capacitor C2 due to the reverse charging of the capacitor C2 through the series circuit of the resistor 45 and the nonlinear inductor L2 during the charging of the capacitor C.

The discharge lamp lighting device of FIG. 13 operates as follows.

When the power source E is switched on, filaments f1 and f2 of the discharge lamp FL are heated by the voltages induced in the filament windings 43. At the same time, when voltage of the power source E is supplied, the potential from the point G is supplied to the high voltage generating circuit R2 through the lag phase ballast B and the impedance circuit for the oscillating operation of the high voltage generating circuit R2. The high frequency, high voltage VC, which appears as a result of the oscillating operation, and the step-up voltage in the power source E from the transformer T are added and applied to the discharge lamp FL to start it when the filament is heated enough.

FIG. 14 shows an approximate vector diagram for the lighting operation of the discharge lamp FL. The peak terminal voltages VFL of the discharge lamp FL and VB of the ballast B are shown. In this diagram E41 is the maximum voltage induced at the primary winding 41, E42 is the maximum voltage induced at the supplementary winding 42 and VG is the maximum potential point G when the a.c. power source E is switched on. As seen in FIG. 14, the peak voltage VO applied to the high voltage generating circuit R2 from the terminal voltage VFL of the discharge lamp is offset vectorially and becomes a low voltage. FIG. 15 shows the waveforms of the terminal voltage VFL of the discharge lamp and the voltage VO applied to the high voltage generating circuit R2, in which the voltage applied to the high voltage generating circuit R2 is decreased as compared to the terminal voltage VFL to a larger extent than previously described with reference to FIG. 12.

In comparison with the device of FIG. 10, the device of FIG. 13 is adapted for a high output type 110 watt fluorescent lamp FL, the power source has 200 volts and the supplemental winding 42 of the transformer T has an induced voltage of 100 volts. The potential point G constitutes one terminal of the power source E. As a result, the discharge lamp starts very well and the peak voltage applied to the high voltage generating circuit R2 during the operation is greatly reduced to 180 volts as compared to about 250 volts in FIG. 10. Accordingly, the circuit of FIG. 13 may use two series connected thyristors, each having a breakdown voltage of about 100 volts. Further, the lag phase device may be of small size by omitting the large capacity current limiting capacitor needed for the connection to the lead phase device.

Another advantage of the circuit shown in FIG. 13 is seen in that this circuit is not limited to the power source connection illustrated. For instance, a power source of 100 volts may be connected across the supplemental winding 42 or it may be connected between the middle points of both windings 41 and 42, and further the lag phase ballast B may be connected to the output terminal (a) of the transformer T. Therefore, the circuit of FIG. 13 is especially suitable for use in connection with 100 or 200 volt power supply lines.

FIG. 16 shows another embodiment of a lighting device for two discharge lamps according to the invention. FIG. 16 comprises the circuit of FIG. 13 and an additional circuit including a lead phase ballast B2 having a series circuit of a linear inductor and a capacitor 10, and a discharge lamp FL2 in series and connected across the primary winding 51 of the transformer T. A capacitor CP is connected between the point (d) of the impedance circuit and the discharge lamp FL1 and the point (e) of the lead phase ballast B2 and the discharge lamp FL2. In this arrangement one high voltage generating circuit R2 is used for starting two discharge lamps FL1 and FL2. The discharge lamp FL2 without the circuit R2 must be started prior to the discharge lamp FL1 within the circuit R2. For this purpose, the filaments f11 and f12 of the discharge lamp FL1 are connected to respective windings 57 which are electromagnetically coupled to the ballast B2. The filaments f21 and f22 of the discharge lamp FL2 are connected respectively to windings 59 of the transformer T.

In operation the high frequency, high voltage produced in the high voltage generating circuit R2 is applied to the discharge lamp FL2 through the capacitor CP together with the voltage V51 induced in the primary winding 51. The heating voltage induced on the windings 59 is applied to the filaments f21 and f22. On the other hand, until the discharge lamp FL2 is lighted, heating of the filaments f11 and f12 of the discharge lamp FL1 is prevented, because no voltage is induced in the windings 57 since no current is flowing at this time through the linear inductor of the ballast B2. Thus, the discharge lamp FL2 is started first. After starting of the discharge lamp FL2, current flows in the linear inductor L1 of the ballast B2 and a voltage is induced in the windings 57 and applied to heat the filaments f11 and f12 of the discharge lamp FL1. Thus, the high voltage generating circuit R2 is continuously operated to start the discharge lamp FL1 and both discharge lamps are properly lighted and the voltage of the power source is optional.

In the above circuits of this invention, the transformer T may be replaced with a leakage transformer. In such a case the lag phase ballast B1 will be a part of or will constitute the entire leakage transformer, whereby the device may be advantageously of a very small size. Another advantage is seen in that the lighting device of this invention is not limited to fluorescent lamps, but also applicable to high pressure mercury lamps, high pressure sodium lamps, metal halide lamps and so on.

FIG. 17 illustrates a discharge lamp lighting circuit employing a peak leakage transformer system in accordance with this invention. This embodiment is especially efficient in reducing the power loss and the weight of the device. The arrangement comprises in combination the backswing booster as shown in FIG. 5 and a leakage transformer having a phase advancing capacitor. The leakage transformer T has a primary winding 61, a secondary winding 62 acting as the linear inductance L1, an intermediate tap 63 on the primary winding 61, and a pair of windings 64 for heating the filaments of a discharge lamp FL. The output voltage of this leakage transformer T is 190 volts which is close to the 200 volt source voltage of the power source E and has a distorted waveform as shown in FIG. 18. The lead peak voltage is generated by providing a gap in the leg of the magnetic path of the leakage transformer T. This lead peak voltage is applied to the high voltage generating circuit R2 to initiate its oscillating operation and it is used to suppress the spike voltage appearing during the operation. The spike voltage is suppressed by way of a phase adjustment of the peak voltage VPK of the output voltage VB relative to the spike voltage VFLS of the lamp voltage VFL. FIG. 18 shows the waveforms of these voltages suitable for attaining the object of this invention. That is, the end portion of the peak voltage VPK in the output voltage VB of the leakage transformer T is so controlled as to advance the upstanding or positive portion of the spike voltage VFLS of the lamp voltage VFL.

On the other hand, the intermediate tap 63 on the primary winding 62 is located at a point below 100 volts for reducing the magnitude of the upstanding or positive portion of the lamp voltage VFL. Thus, the ballast B may be of a very small size. In this circuit arrangement, the phase advancing capacitor 10 has a discharging resistor 11 and its terminal voltage is 200 volts. The circuit arrangement is similar to the circuit of FIG. 10. A capacitor C2 of the impedance circuit may be miniaturized by using a terminal voltage of 200 volts. The function of a bias coil 66 is the same as that of the bias coil 46 in FIG. 13. Similarly, the function of a resistor 68 is the same as that of the resistors 34 and 38 in FIG. 10. The size of the resistor 68 is determined with due regard to proper operation, but the loss due to the resistor 68 may be smaller than that due to the resistors 34 and 38 of FIG. 10.

FIG. 19 illustrates a circuit arrangement of a lag phase lamp lighting device in accordance with this invention, in which the polarity of the voltage applied to the switching semiconductor S is reversed during the operation, contrary to the operation of the circuit of FIG. 17. In this circuit arrangement of FIG. 19, a leakage transformer T, which is used as a ballast B having a linear inductance characteristic, provides a primary winding 71 having a tap 73 and an output winding 72 which has a pair of secondary windings 74 for heating the filaments of the discharge lamp FL. The arrangement of the windings 74 reduces the power loss by decreasing the voltage applied to the filaments during operation. In this case, the output voltage of the ballast is about 280 volts. Hence, the voltage needed for operating the high voltage generating circuit R2 may be reduced to 180 volts by establishing the tap 73 at a point of 100 volts. This feature permits miniaturizing the backswing booster and to use thyristor means having a breakdown voltage of 200 volts. A bias coil 76 and a resistor 75 have the same functions as in FIG. 13. The capacitor 20 is connected across the power source E for power factor correction. The arrangement of the discharging resistor 75 connected across the capacitor C2 and the nonlinear inductor L2 is preferred to assure a rapid discharging of the capacitor C2 because the nonlinear inductor is located in the discharging path.

FIG. 20 illustrates a further circuit of a lighting device for two discharge lamps according to the invention particularly suitable for 110 watt high output fluorescent lamps FL1 and FL2. This device provides a flickerless system. The first discharge lamp FL1 is operated in advanced phase as shown in FIG. 10. The second discharge lamp FL2 is operated in lag phase as shown in FIG. 14. In this arrangement which includes components similar to the above described circuits, the high frequency, high voltage of the high voltage generating circuit R2 is applied to both the first and the second discharge lamps FL1 and FL2. The terminal voltages across the thyristor S during operation are arranged to cancel each other.

The arrangement of FIG. 20 comprises a power source E, a first lamp lighting circuit including a first ballast B1 in lead phase having a linear inductor L1 and a phase advancing capacity 10 with a discharging resistor 11, and the first discharge lamp FL1; a second lamp lighting circuit including a second ballast B2 in the form of a leakage transformer T with a primary winding 81 and secondary winding 82, and the second discharge lamp FL2, and the high voltage generating circuit R2 having a bias coil 86 and an impedance circuit of a capacitor C2 and its parallel resistor 84, and a winding 80 on the transformer T. The high voltage generating circuit R2 is connected between the junction of the first ballast B1 and the first discharge lamp FL1 and the junction of the second ballast B2 and the second discharge lamp FL2. Further, a pair of windings 91 for heating the filaments of the second discharge lamp FL2 is formed on the secondary winding 82 of the second ballast B2. A pair of windings 92 for heating the filaments of the first discharge lamp FL1 is formed on the primary winding 81 and the linear inductor L1 of the first ballast B1. By this connection a reduction of power loss of the electrode is achieved.

In the arrangement of FIG. 20, since the starting voltage includes odd harmonic components of the power source E, the winding 80 is added as part of the leakage transformer T for checking the fundamental component of the starting voltage applied to the high voltage generating circuit R2 and for diminishing the peak value of such voltage. FIG. 21 shows approximately the waveform of such a voltage. This winding 80 also supplies voltage for maintaining the oscillating operation of the high voltage generating circuit R2 after one of the discharge lamps is lighted. At starting the high frequency, high voltage of the high voltage generating circuit R2 is checked equally by the inductance of the ballasts B1 and B2. The voltage applied to each discharge lamp FL1 and FL2 is the total voltage of one half output voltage of the circuit R2 and the output voltage of the transformer T. When one of the discharge lamps is lighted, the high frequency voltage applied to the lighted discharge lamp is stopped by the checking function of the ballast B1 or B2 due to its lamp current. Accordingly, the high frequency, high voltage in intermittent oscillation is shifted to the other discharge lamp to start sequentially. A high power factor is also achieved by the cancellation lead and lag currents without any adjusting means for the power factor. As a result, each ballast may be of rather small size in this lighting device for two lamps.

Although the invention has been described with reference to specific example embodiments, it is to be understood that it is intended to cover all modifications and equivalents within the scope of the appended claims.

What is claimed is:

1. In a discharge lamp lighting device comprising a discharge lamp, a power source, ballast means connected in series with said discharge lamp; and a backswing booster for igniting said discharge lamp; the improvement comprising a source voltage supply circuit coupling said source to said discharge lamp and said backswing booster for operating said discharge lamp and said backswing booster at different voltages, wherein the voltage applied to said discharge lamp enables said discharge lamp to sustain an arc discharge of said discharge lamp when it has been ignited, and wherein the voltage applied to said backswing booster is so established to operate said backswing booster when its starts and to disable operation of said backswing booster by decreasing the maximum vector of said applied voltage when said discharge lamp is ignited and operating.

2. The device of claim 1, wherein said backswing booster comprises a capacitor having a capacitance resonant with the inductance of said ballast means at a frequency higher than that of said power source so as to generate a momentary high voltage oscillation by flowing intermittent current.

3. The device of claim 1, wherein said source voltage supply circuit comprises a transformer having different voltage taps.

4. The device of claim 3, wherein said ballast means comprises a linear inductor and a phase advancing capacitor, and wherein said transformer has a supplemental winding connected to operate said backswing booster by a vectorially added voltage when it starts, and to reduce the voltage applied to said backswing booster when said discharge lamp is ignited and operating.

5. The device of claim 4, further comprising a second discharge lamp connected to said transformer, and second ballast means connected in series with said second discharge lamp, said second ballast means comprising a lag phase current limiter, wherein the output of said backswing booster is connected across said first discharge lamp through said second ballast means and across said second discharge lamp through said first ballast means, whereby the voltage applied to said backswing booster at starting is reduced by offsetting voltage when said first and second discharge lamps are ignited and operating.

6. The device of claim 3, wherein said ballast means comprise a lag phase current limiter, and wherein said transformer has a potential tap connected to said backswing booster, said potential tap being positioned to operate said backswing booster when it starts and to reduce the voltage applied to said backswing booster when said discharge lamp is ignited and operating.

7. The device of claim 6, further comprising a second discharge lamp connected to said transformer and second ballast means connected in series with said second discharge lamp, said second ballast means comprises a linear inductor and a phase advancing capacitor, wherein the output of said booster is connected across said first discharge lamp and said second discharge lamp, whereby the voltage applied to said backswing booster at starting is reduced when said first and second discharge lamp are ignited and operating.

8. The device of claim 3, wherein said transformer is a leakage transformer having a substantially linear inductance, said inductance being included in said ballast means.

9. The device of claim 8, further comprising a phase advancing capacitor connected in series with said leakage transformer for producing an output voltage having a lead peak waveform, whereby the peak in said voltage waveform is located in advance of the upstanding or positive portion of the lamp voltage across said discharge lamp to initiate operation of said backswing booster by the output voltage of said leakage transformer and to stop the operation of said backswing booster when said discharge lamp is ignited and operating.

10. A discharge lamp lighting device comprising ballast means, a source voltage supply circuit having first and second output terminals for applying different voltages, a discharge lamp connected to said first output terminals through said ballast means, and a high voltage generating circuit connected to said second output terminals, and comprising an oscillation capacitor connected across said second output terminals and a series circuit of a nonlinear inductor and switching semiconductor means connected in parallel with said oscillation capacitor, said nonlinear inductor having distributed capacity for generating backswing oscillations, the voltages at said first and second output terminals being selected to enable operation of said high voltage generating circuit when it starts and to discontinue operation of said high voltage generating circuit by decreasing the maximum vector of the voltage applied to said high voltage generating circuit when said discharge lamp is ignited and operating.

* * * * *